United States Patent [19]

Fleischhauer

[11] Patent Number: 4,809,395

[45] Date of Patent: Mar. 7, 1989

[54] CANISTER TYPE VACUUM CLEANER

[76] Inventor: Eugene T. Fleischhauer, 1413 Wesanne La., Midlothian, Va. 23113

[21] Appl. No.: 114,790

[22] Filed: Oct. 28, 1987

[51] Int. Cl.[4] ..... A47L 9/00

[52] U.S. Cl. ..... 15/327 F; 15/327 B

[58] Field of Search ..... 15/327 F, 327 B, 327 E, 15/339, 327 R

[56] References Cited

U.S. PATENT DOCUMENTS

| | | | |
|---|---|---|---|
| D. 172,136 | 5/1954 | Florian | 15/327 E X |
| 1,573,771 | 2/1926 | McClatchie . | |
| 1,721,459 | 7/1929 | McClatchie | 15/327 R |
| 2,433,356 | 12/1947 | French | 280/43 |
| 2,438,133 | 3/1948 | Sparklin | 15/344 X |
| 2,653,342 | 9/1953 | Bonin et al. | 15/327 R |
| 3,015,122 | 1/1962 | Cook | 15/327 B |
| 3,023,838 | 3/1962 | Gaudry | 15/410 X |
| 3,142,857 | 8/1964 | Fresard et al. | 15/327 E |
| 3,353,338 | 11/1967 | Nilsson | 55/276 |
| 3,591,888 | 7/1971 | Tzkeda | 15/323 |
| 3,619,850 | 11/1971 | Rideout et al. | 15/323 |
| 3,621,640 | 11/1971 | Ohno et al. | 55/300 |
| 3,883,922 | 5/1975 | Fleischhauer | 15/327 R |
| 3,950,814 | 4/1976 | Fleischhauer | 15/327 E |

FOREIGN PATENT DOCUMENTS

| | | | |
|---|---|---|---|
| 381961 | 1/1924 | Fed. Rep. of Germany | 15/327 F |
| 160360 | 9/1957 | Sweden | 15/327 F |

*Primary Examiner*—Chris K. Moore

*Attorney, Agent, or Firm*—Hughes, Cassidy & Multer

[57] ABSTRACT

Canister type vacuum cleaners having a casing with convex sides which allow the vacuum cleaner to be pulled or otherwise displaced along a supporting surface irrespective of which side of the surface is facing downwardly and engaging that surface. A roller supported from a casing side wall at the base of the vacuum cleaner or one roller in an array which includes a roller supported from each casing side wall at the base end of the vacuum cleaner can be engaged with the supporting surface to increase the mobility of the vacuum cleaner. These rollers do not affect the insensitivity to orientation of the vacuum cleaner.

15 Claims, 2 Drawing Sheets

CANISTER TYPE VACUUM CLEANER

TECHNICAL FIELD OF THE INVENTION

The present invention relates to vacuum cleaners. More specifically, it relates to canister type vacuum cleaners which: (1) have all of the attributes and advantages of those disclosed in my earlier issued patents Nos. 3,883,922 dated May 20, 1975, and 3,950,814 dated Apr. 20, 1976, and both entitled VACUUM CLEANERS, but (2) have the mobility imparted to the latter with a wheeled dolly without the restrictions on the orientatins in which the vacuum cleaner can be used that are associated with the employment of the dolly.

BACKGROUND OF THE INVENTION

Vacuum cleaners of the canister type are disclosed in a number of U.S. patents. Those of which I am aware include may earlier issued patents identified above and U.S. patents Nos. 1,573,771 to McClatchie; 2,433,356 to French; 2,438,133 to Sparklin; 2,591,305 to Segesman; 2,634,451 to Dow; 3,002,215 to MacFarland; 3,023,838 to Gaudry; 3,089,177 to Andersson-Sason; 3,142,857 to Fresard et. al.; 3,270,365 to Waters et al.; 3,328,826 to Amos; and 3,621,640 to Ohno et al.

Canister type vacuum cleaners generally consist of a motor and a vacuum pump, a compartment housing a dust filter, a suction hose, an assortment of cleaning tools, a power cord and switch, and a tanklike casing or canister. The motor and pump, dust filter, and power switch are usually located in the canister of the cleaner with the hose communicating through one end of the canister with the dust filter compartment and the power cord entering the canister at the opposite end.

The canisters of such vacuum cleaners are usually horizontally oriented cylinders or polygonal like boxes and spheres oriented in a variety of attitudes.

To facilitate movement over rugs, bare floors, thresholds, etc., canisters, wheels, runners, pneumatic flotation elements, glides, etc., are usually attached to the canisters. Also, elastomeric bumpers are usually provided to reduce contact with furniture and the like. Further, a handle is provided to facilitate carrying the canister from place to place.

Because they protrude from the canister, casters and the like, bumper strips, and handles become engaged with rug edges, thresholds, rocker runners, furniture legs and feet, etc. They also cause the canister to move in undesired directions, defeating their purpose.

Conventional canister type cleaners also have protruding knobs, hinges, latches, etc. and a protrusion at the hose junction, all of which are apt to catch on table and chair legs, sharp corners of furnishings, etc.

These inconvenient and vexatious situations are often compounded by the cleaner being upset when the user tries to dislodge the machine. Then, he must stop to right the machine or drag the cleaner in its upset attitude, which increases its tendency to hang up on obstacles and makes the power switch inaccessible or very inconvenient to reach.

In addition to the foregoing inadequacies, the usual canister type cleaner is low to the floor and provides a poor and inconvenient platform upon which to drape the hose and/or to support the conventional, relatively long, rigid wand. This results in a generally unkempt sprawl of vacuum cleaner and appendages on the floor of the storage area.

My prior patents Nos. 3,883,922 and 3,950,814 disclose certain novel, improved vacuum cleaners of the canister type which do not have the above-enumerated drawbacks. Briefly, those novel vacuum cleaners include an elongated body or casing contoured so that the cleaner will glide easily across the surface of the area being cleaned. Preferably, the contour will be selected so that the cleaner can glide easily on its top and sides as well as its bottom, thereby making it orientation insensitive.

A detachable, wheeled dolly can be coupled to the vacuum cleaner to increase its mobility. Unfortunately, this dolly limits the number of orientations which the vacuum cleaner can usefully assume when the dolly is coupled to the vacuum cleaner.This makes the vacuum cleaners disclosed in my issued patents significantly less versatile when the dolly is attached than they are when that component is absent.

SUMMARY OF THE INVENTION

I have now invented, and disclosed herein, certain new and novel canister type vacuum cleaners which have the mobility afforded by the dollies of those disclosed in my '922 and '814 patents but do not have the restrictions on orientation appurtenant to those dollies. This novel and worthwhile objective is achieved by mounting an elongated roller in the base of the vacuum cleaner housing.

The just-described roller can be rotated downwardly into engagement with the surface from which the vacuum cleaner is supported when that end of the vacuum cleaner opposite the base—the nose end—is elevated. This is typically accomplished by pulling upwardly on a conventional vacuum hose detachably coupled to tht end of the vacuum cleaner housing to connect the vacuum cleaner pump to any selected one of a number of vacuum cleaner attachments; e.g., one as disclosed in my U.S. patents Nos. 4,638,527 and 4,653,137. Those patents were issued Jan. 27, 1987, and Mar. 31, 1987 respectively. Both are titled VACUUM CLEANER ATTACHMENTS.

With the roller engaging the supporting surface and the nose of the vacuum cleaner elevated so that the body of the vacuum cleaner clears that surface, the vacuum cleaner can easily and conveniently be rolled from place to place.

A further increase in mobility can be achieved by employing an array of rollers as just described and of the same diameter at the base end of the vacuum cleaner housing. One roller is located at the base end of each of the several sides of the housing, and the axes of rotation of the rollers all lie in a plane which extends at right angles to the longitudinal centerline of the vacuum cleaner housing. With the just-described roller system installed and a one-to-one correspondence between the number of rollers and the number of vacuum cleaner housing sides, one of the rollers can be brought into engagement with the vacuum cleaner-supporting surface irrespective of the side of the vacuum cleaner housing that is facing that surface. At the same time, the above-described orientation of the roller axes relative to each other and the vacuum cleaner base and the fact that the rollers have the same diameter allow the vacuum cleaner to be oriented in an upright position in circumstances where that is desirable—for example, in storing it.

Aside from the roller system just described, the novel vacuum cleaners disclosed herein will typically moreor-less duplicate those disclosed in my '922 and '814 patents. For example, one or more hand grips may be formed in the casing so that the cleaner can be readily transported from place-to-place. All hand grips are faired into the casing and the vacuum cleaner is otherwise kept free of protuberances so that there will be no projections to catch on, tangle with, or damage furniture, drapes, moldings, etc.

Aside from those discussed above, the novel vacuum cleaners disclosed herein have the advantage of being simple and therefore inexpensive to manufacture and service. They are also easy to manipulate, handle, and store and have the further advantage that they do not leave "tracks" in rugs and similar coverings over which they may be pulled.

OBJECTS OF THE INVENTION

From the foregoing, it will be apparent to those skilled in the relevant arts that the primary object of the present invention resides in provision of novel, improved vacuum cleaners of the portable, canister type.

Other important but more specific objects of the invention reside in the provision of vacuum cleaners in accord with the preceding object which:

have the mobility imparted to the vacuum cleaners disclosed in my '922 and '814 patents by a wheeled dolly but do not have those restrictions that are appurtenant to the employment of the dolly;

are simple and therefore comparatively inexpensive to manufacture and service and yet efficient in operation;

are mobile, convenient to use, versatile, and easy to handle and carry; and are compact and easy to store and furnish a support for the vacuum hose and the power cord.

Still other important objects and advantages and further novel features of the present invention will become apparent from the appended claims and as the ensuing detailed description and discussion proceeds in conjunction with the accompanying drawing.

DETAILED DESCRIPTION OF THE INVENTION

Figure 1:
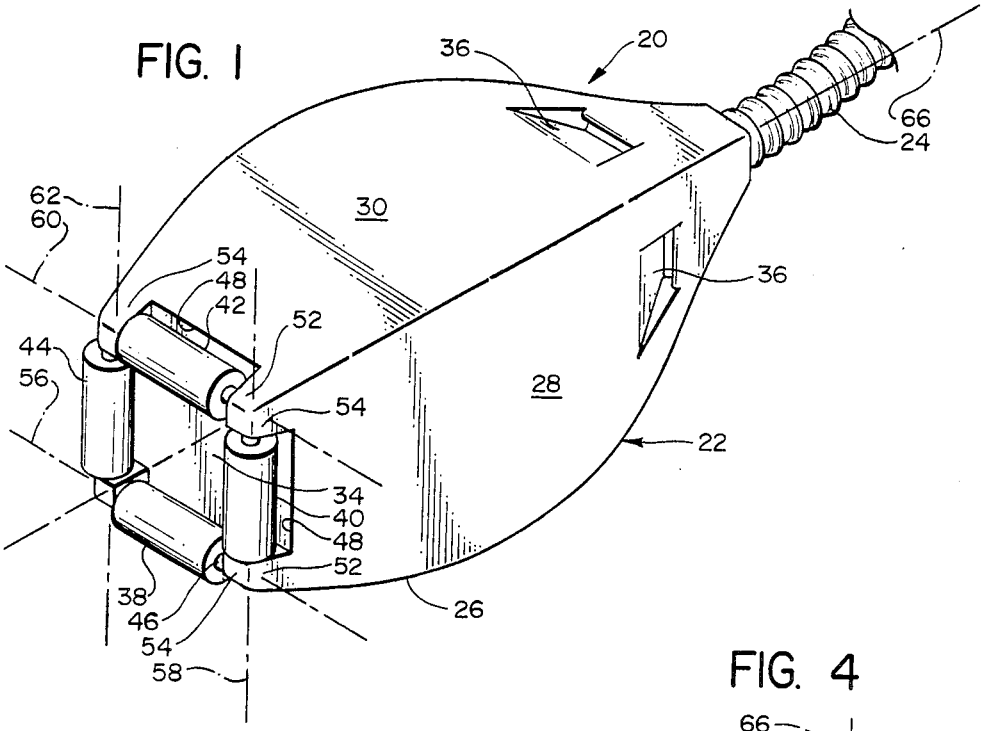
FIG. 1 is a generally isometric view of a canister type vacuum cleaner embodying, and constructed in accord with, the principles of the present invention.

Referring now to the drawings, FIGS. 1–4 show, in detail, one exemplary vacuum cleaner 20 constructed in accord with and embodying the principles of the present invention. Vacuum cleaner 20 includes an external casing 22 housing a vacuum pump, a motor for driving the pump, and a dustbag. None of these internally housed components have been shown as they are not part of the present invention. For the sake of completeness, however, the reader is informed that those components may be of the character and installed and related to each other and casing (or housing) 22 in the manner described in my '922 and '814 patents.

A conventional vacuum hose 24 is detachably coupled to casing 22 at the front or upper end of the casing. This hose communicates with the dustbag in casing 22.

The casing 22 of vacuum cleaner 20 includes four orthogonally related side walls 26, 28, 30, and 32 of substantially identical configuration. Each of the four side walls is continuously convex in a longitudinal direction. This external configuration of the vacuum cleaner makes it slide easily both forward and backward and pivot easily in response to manipulation of hose 24 or the accessory (not shown) attached to it when the vacuum cleaner is oriented in the position shown in FIG. 2. This is the orientation generally employed when the vacuum cleaner is being used.

Figure 2:
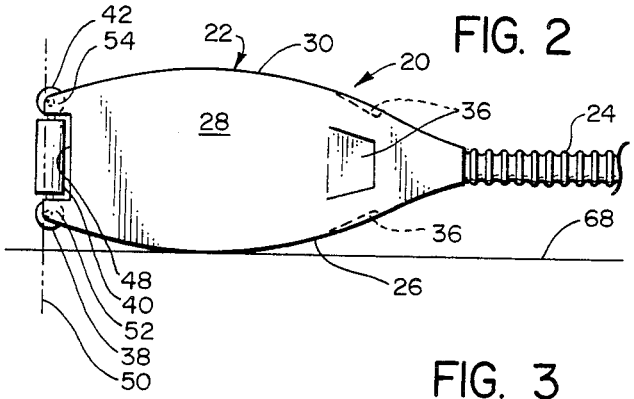
FIG. 2 is an elevation of the vacuum cleaner with the latter lying on one side; this is a typical position assumed by the vacuum cleaner when it is in use.

The external configuration just described also makes the vacuum cleaner insensitive to orientation when the vacuum cleaner is oriented in the position shown in FIG. 2. That is, as far as its mobility is concerned, it makes no difference whether the vacuum cleaner is resting on one or another of its four sides 26 . . . 32.

Another advantage of this novel casing configuration is that it provides an elongated, relatively slender nose on which the vacuum hose and power cord of the casing can be wound for storage.

The rear or lower end of casing 22 is closed by a base 34 (see FIG. 1). A hand grip 36 is formed in each of the four walls 26 . . . 32 of vacuum cleaner casing 22 so that the vacuum cleaner may be carried from place-to-place. This is facilitated because of the shape which the vacuum cleaner has when it is oriented in the vertical or upright position illustrated in FIG. 4.

Hand grips 36 are faired into the casing and do not protrude beyond the walls in which they are formed. Consequently, the vacuum cleaner will glide equally well on any of its four sides 26 . . . 32 when the vacuum cleaner is used in its typical, horizontal orientation.

As similar hand grips 36 are formed in all four sides 26 . . . 32 of vacuum cleaner housing 22, one of the hand grips will be readily accessible irrespective of the the side of the casing which may be down when the vacuum cleaner is in use.

It was pointed out above that the vacuum cleaner casing configuration illustrated in FIGS. 1–4 makes the vacuum cleaner highly mobile. In accord with the principles of the present invention, however, four elongated, orthogonally related rollers 38, 40, 42, and 44 of equal diameter are provided to even further increase the mobility which the vacuum cleaner has. These rollers are supported on a one-to-one basis from walls 26 . . . 32 of vacuum cleaner housing 22 at the base 34 of that housing.

More specifically, each of the elongated rollers 38 . . . 44 is journalled on an axle 46; and the axle is supported from the associated vacuum cleaner housing side wall 26 . . . 32. In particular, the roller 38 . . . 44 fits in a recess 48 which opens onto the base end 50 of the associated side wall. The roller protrudes both beyond the external envelope of the side wall and the base 34 of the vacuum cleaner casing. Opposite ends of each roller-supporting axle 46 are journalled in two, spaced apart, longitudinally extending flanges or bosses 52 and 54. These are located at opposite sides of roller-receiving recess 48 at the base end of each casing side wall 26 . . . 32. As is best shown in FIG. 1, each boss 52 at the base end of one casing side wall 26 . . . 32 is integral with the boss 54 at the same end of the next casing side wall 28, 30, 32, or 26.

As is best shown in FIG. 1, the four axes of rotation 56, 58, 60, and 62 of rollers 38 . . . 44 lie in a common plane 64. This plane intersects the longitudinal centerline (or axis of symmetry) 66 of vacuum cleaner 20 at a right angle. The axes of rotation 56 . . . 62 of rollers 38 . . . 44 lie at equal distances from, and are symmetrically related relative to, vacuum cleaner longitudinal centerline 66. They are oriented at right angles to each other.

Typically, in use, vacuum cleaner 20 will be oriented as shown in FIG. 2 with its longitudinal axis horizontal and one of its sides—in this case 26—facing downwardly and engaging a supporting surface 68 (for example, the upper surface of a floor covering being cleaned). As discussed above, vacuum cleaner 20 can be easily pulled by hose 24 or otherwise displaced along surface 68 because of the convex contour of the side 26 of the vacuum cleaner casing 22.

Figure 3:
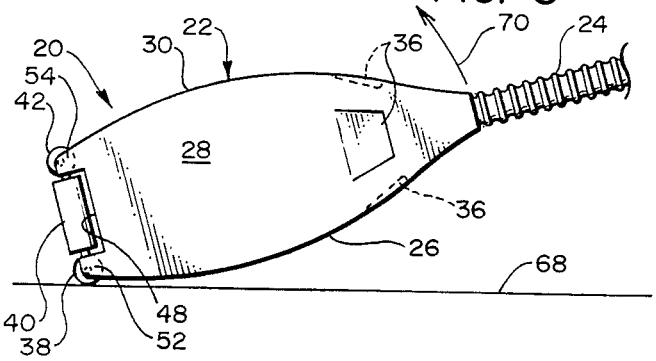
FIG. 3 is a view similar to FIG. 2 but with one of four elongated, base-mounted rollers contacting the vacuum cleaner supporting surface and the vacuum cleaner housing clearing that surface, this orientation imparting increased mobility to the vacuum cleaner.

The mobility of vacuum cleaner 20 can be increased even further by rotating it in a counterclockwise direction as shown by arrow 70 in FIG. 3 until the roller 38 supported at the base end of casing side wall 26 (or the roller 40 . . . 42 associated with one of the other side walls 28 . . . 32) engages vacuum cleaner supporting surface 68 and side wall 26 clears that surface. This can be easily and readily accomplished by exerting an upwardly directed force on the vacuum cleaner hose 24.

With vacuum cleaner 20 in the orientation shown in FIG. 3, the sliding friction between casing side wall 26 and supporting surface 68 is replaced by the significantly lower rolling friction between roller 38 and the supporting surface. This reduction in friction facilitates the displacement of vacuum cleaner 20 across supporting surface 68.

I pointed out above that this novel arrangement is orientation insensitive; i.e., that the foregoing modus operandi is the same, irrespective of which of the four sides 26 . . . 32 of vacuum cleaner casing 22 may be facing downwardly. This makes vacuum cleaners as disclosed herein significantly easier to use than: (1) those of conventional character, and (2) those disclosed in my '922 and '814 patents if the dolly is attached. The latter and those of conventional construction are orientation specific in that a particular side of the vacuum cleaner casing must face down so that the wheels of the vacuum cleaner or vacuum cleaner dolly will engage the surface on which the vacuum cleaner is supported.

Figure 4:
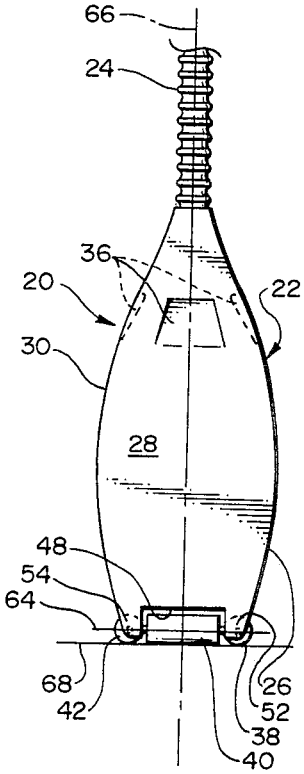
FIG. 4 is an elevation showing the vacuum cleaner supported by the base-mounted rollers in an upright position which reduces the area required to store it.

Furthermore, FIG. 4 makes it apparent that the novel arrangement of mobility imparting rollers described above provides a stable support for vacuum cleaner 20 when the latter is oriented with its longitudinal centerline 66 vertical as it is for storage, for example.

Figure 5:
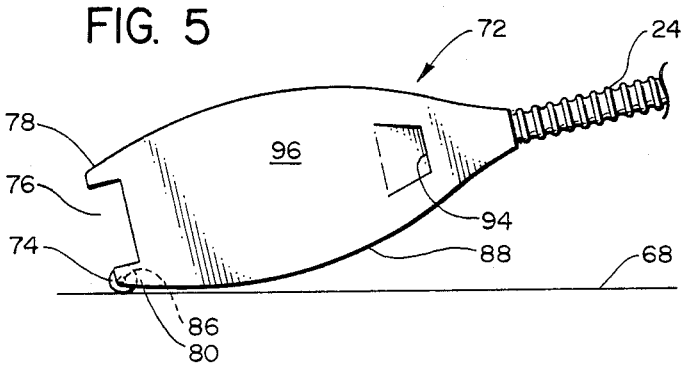
FIG. 5 is a view, similar to FIG. 3, of a second canister type vacuum cleaner embodying, and constructed in accord with, the principles of the present invention.
Figure 6:
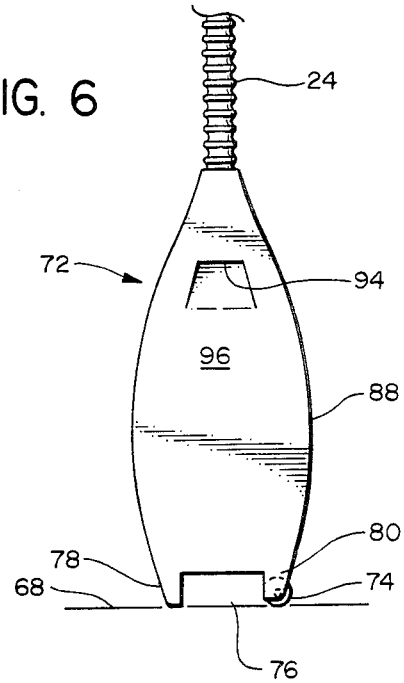
FIG. 6 is an elevation of the vacuum cleaner of FIG. 5 in an upright position.

Referring still to the drawing, FIGS. 5 and 6 depict a vacuum cleaner 72 which differs from vacuum cleaner 20 primarily in that vacuum cleaner 72 has only a single roller 74 at its base 76. Also, the two lugs 78 (one shown) opposite the lugs 80 (also one shown) between which roller 74 is journalled are longer than the latter. This ensures that vacuum cleaner 72 will remain upright when it is stored or otherwise oriented in the vertica position shown in FIG. 6.

Turning now to FIG. 5, elongated roller 74 is journalled on an axle 86, and the axle is supported from housing side wall 88. In particular, the roller 74 fits in a recess (not shown) like those identified by reference character 48. This recess opens onto that end of side wall 88 at the base 76 of vacuum cleaner 72. The roller protrudes both beyond the external envelope of the side wall and the base end 76 of the vacuum cleaner casing. Opposite ends of roller-supporting axle 86 are journalled in the two, spaced apart, longitudinally extending lugs 80 as discussed above. These are located on opposite sides of the roller-receiving recess at the base end of side wall 88.

Vacuum cleaner 72 also differs from vacuum cleaner 20 in that it has only a single handle or hand grip (identified by reference character 94). This handle is formed in one of the two side walls (96) adjacent that vacuum cleaner housing side wall 88 which carries roller 74 at its lower end.

Although it is not orientation insensitive, the vacuum cleaner 72 illustrated in FIGS. 5 and 6 has the advantage that it is made mobile without a dolly and in a simpler and less expensive manner than the vacuum cleaner 20 of FIGS. 1–4.

As suggested above, vacuum cleaners 20 and 72 are alike in many respects. The same reference characters have been employed to identify those components of the two vacuum cleaners which are the same.

From the foregoing, it will be apparent to the reader that my invention may be embodied in many specific forms in addition to those disclosed above without departing from the spirit or essential characteristics of the invention. The embodiments of the invention disclosed herein are therefore to be considered in all respects as illustrative and not restrictive. The scope of the invention is instead indicated by the appended claims, and all changes which come within the meaning and range of the equivalency of the claims are therefore intended to be embraced therein.

What is claimed as the invention is:

1. A canister type vacuum cleaner which has an elongated casing with a base and an elongated, enclosure defining, supporting surface engageable side wall extending from said base, said vacuum cleaner further comprising an elongated element rotatably supported relative to said side wall at the base end of the vacuum cleaner and in a recess in said casing for promoting the movement of the vacuum cleaner relative to the supporting surface.

2. A canister type vacuum cleaner which has an elongated casing with a base and a plurality of elongated, enclosure defining, supporting surface engageable side walls extending from said base, said casing side walls having a convex contour which facilitates the displacement of the vacuum cleaner over a supporting surface faced and engaged by one of said side walls and said vacuum cleaner further comprising rolling means supported from said casing at the base thereof for promoting the movement of the vacuum cleaner relative to the supporting surface irrespective of which the casing side walls is facing the supporting surface.

3. A canister type vacuum cleaner which has an elongated casing with a base and an elongated, enclosure defining, supporting surface engageable side wall extending from said base, said vacuum cleaner further comprising an element rotatably supported relative to said side wall at the base end of the vacuum cleaner for promoting the movement of the vacuum cleaner relative to the supporting surface, there being a rotatable element-receiving recess in the base-associated end of the vacuum cleaner casing side wall which opens onto that end of the side wall and is defined by two, spaced apart, longitudinally extending flanges, said rotatable element being located in said recess, and the means for promoting the movement of the vacuum cleaner relative to the supporting surface further including an axle which extends through the rotatable element and is journalled in said flanges.

4. A canister type vacuum cleaner as defined in claim 3 wherein said rotatable element protrudes beyond the casing side wall from which it is supported, whereby the rotation of said vacuum cleaner on said side wall will first move said rotatable element downwardly into engagement with said supporting surface and then displace the vacuum cleaner casing upwardly and out of engagement with that surface, thereby replacing the sliding friction between the vacuum cleaner casing and the supporting surface with the lower magnitude rolling friction between the surface engaged element and the supporting surface to thereby facilitate the movement of the vacuum cleaner across the surface.

5. A canister type vacuum cleaner as defined in claim 1 wherein the elongated casing has means at the base of the vacuum cleaner and on the opposite side of said casing from said side wall which cooperates with said rotatable element to support the vacuum cleaner in an upright position when the vacuum cleaner is thus oriented on the supporting surface.

6. A canister type vacuum cleaner which has an elongated casing with a base nd an elongated, enclosure defining, supporting surface engageable side wall extending from said base, said vacuum cleaner further comprising a single rolling element and means rotatably supporting said element relative to said side wall at the base end of the vacuum cleaner for promoting the movement of the vacuum cleaner relative to the supporting surface, sid rotatable element extending from near one edge of said casing side wall to near the other edge of that side wall and said vacuum cleaner still further comprising means at the base of the vacuum cleaner and integral with the side wall of said casing opposite the side wall with which the rotatable element is associated which cooperates with said rotatable element to support the vacuum cleaner in an upright position when the vacuum cleaner is oriented in said upright position on the supporting surface.

7. A canister type vacuum cleaner which has an elongated casing with a base and a plurality of elongated, enclosure defining, supporting surface engageable side walls extending from said base, said vacuum cleaner further comprising elements associated on a one-to-one basis with, and rotatably supported relative to, said side walls at the base end of the vacuum cleaner for promoting the movement of the vacuum cleaner relative to the supporting surface and means supporting each of said rotatable elements relative to the associated side wall at the base of the casing.

8. A canister type vacuum cleaner as defined in claim 7 wherein said rotatable elements protrude equal distances beyond said base and are therefore capable of stably supporting said vacuum cleaner in an upright position.

9. A canister type vacuum cleaner as defined in claim 7 wherein each of said rotatable elements protrudes beyond the casing side wall from which it is supported, whereby the rotation of said vacuum cleaner on said supporting surface-engaged side wall will first move said rotatable element downwardly into engagement with said supporting surface and then displace the vacuum cleaner casing upwardly and out of engagement with that surface, thereby replacing the sliding friction between the vacuum cleaner casing and the supporting surface with the lower magnitude rolling friction between the surface engaged roller and the supporting surface to thereby facilitate the movement of the vacuum cleaner across the surface.

10. A canister type vacuum cleaner as defined in claim 7 wherein all of said rotatable elements are of the same diameter and wherein the axes of rotation of said elements all lie in a plane oriented at right angles to the longitudinal axis of the vacuum cleaner casing and are symmetrically related with respect to said axis.

11. A canister type vacuum cleaner which has an elongated casing with a base and a plurality of elongated, enclosure defining, supporting surface engageable side walls extending from said base, said casing side walls having a convex contour which facilitates the displacement of the vacuum cleaner over a supporting surface faced and engaged by one of said side walls and said vacuum cleaner further comprising means for promoting the movement of the vacuum cleaner relative to the supporting surfaces irrespective of which of the casing side walls is facing the supporting surface, said movement promoting means comprising rotatable elements associated on a one-to-one basis with the side walls of the vacuum cleaner casing and means supporting each of said rotatable elements relative to the associated side wall at the base of the casing.

12. A canister type vacuum cleaner as defined in claim 11 wherein said rotatable elements protrude equal distances beyond said base and are therefore capable of stably supporting said vacuum cleaner in an upright position.

13. A canister type vacuum cleaner as defined in claim 11 wherein each of said rotatable elements protrudes beyond the casing side wall relative to which it is supported, whereby the rotation of said vacuum cleaner on said supporting surface-engaged side wall will first move said rotatable element downwardly into engagement with said supporting surface and then displace the vacuum cleaner casing upwardly and out of engagement with that surface, thereby replacing the sliding friction between the vacuum cleaner casing and the supporting surface with the lower magnitude rolling friction between the surface engaged rotatable element and the supporting surface to thereby facilitate the movement of the vacuum cleaner across the surface.

14. A canister type vacuum cleaner as defined in claim 11 wherein all of said rotatable elements are of the same diameter and wherein the axes of rotation of said elements all lie in a plane oriented at right angles to the longitudinal axes of the vacuum cleaner casing and are symmetrically related wih respect to said axis.

15. A canister type vacuum cleaner as defined in claim 11 wherein there is a rotatable element-receiving recess in the base-associated end of each vacuum cleaner casing side wall which opens onto that end of the side wall and is defined by two, spaced apart, longitudinally extending flanges and wherein the means for promoting the mobility of the vacuum cleaner further includes an axle which extends through the rotatable element and is journalled in said flanges.

* * * * *

UNITED STATES PATENT AND TRADEMARK OFFICE

CERTIFICATE OF CORRECTION

PATENT NO. : 4,809,395

DATED : March 7, 1989

INVENTOR(S) : Eugene T. Fleischhauer

It is certified that error appears in the above-identified patent and that said Letters Patent is hereby corrected as shown below:

Column 1, line 12, "orientatins" should read --orientations--.

Column 1, line 20, "may" should read --my--.

Column 1, line 40, "canisters" should read --casters--.

Column 2, line 34, "tht" should read --that--.

Column 3, line 66, "drawings" should read --drawing--.

Signed and Sealed this

Second Day of July, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,809,395

DATED : March 7, 1989

INVENTOR(S) : Eugene T. Fleischhauer

It is certified that error appears in the above-identified patent and that said Letters Patent is hereby corrected as shown below:

Column 5, line 67, "vertica" should read --vertical--.

IN THE CLAIMS:

Column 7, line 25, "1" should read --3--.

Column 7, line 32, "nd" should read --and--.

Column 7, line 39, "sid" should read --said--.

Column 8, line 58, "wih" should read --with--.